US007918275B2

(12) United States Patent
Clem

(10) Patent No.: US 7,918,275 B2
(45) Date of Patent: Apr. 5, 2011

(54) WATER SENSITIVE ADAPTIVE INFLOW CONTROL USING COUETTE FLOW TO ACTUATE A VALVE

(75) Inventor: Nicholas J. Clem, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/274,078

(22) Filed: Nov. 19, 2008

(65) Prior Publication Data

US 2009/0133869 A1 May 28, 2009

Related U.S. Application Data

(60) Provisional application No. 60/990,536, filed on Nov. 27, 2007.

(51) Int. Cl.
*E21B 47/00* (2006.01)
*E21B 34/00* (2006.01)

(52) U.S. Cl. ..... 166/250.15; 166/380; 166/214; 166/332.1; 166/334.1

(58) Field of Classification Search ..... 166/334.4, 166/332.1, 334.1, 373, 386, 316, 380, 153–156, 166/77.4, 383, 78.1, 321, 304, 312, 323, 166/385, 241.6, 242.2, 214, 206; 174/102 R, 174/105 R, 105 SC, 75 F
See application file for complete search history.

(56) References Cited

U.S. PATENT DOCUMENTS 1,362,552 A 12/1920 Alexander et al.
1,649,524 A 11/1927 Hammond
1,915,867 A 6/1933 Penick
1,984,741 A 12/1934 Harrington
2,119,563 A 3/1937 Wells
2,089,477 A 8/1937 Halbert
2,214,064 A 9/1940 Niles
2,257,523 A 1/1941 Combs (Continued)

FOREIGN PATENT DOCUMENTS

CN 1385594 12/2002

(Continued)

OTHER PUBLICATIONS

Dikken, Ben J., Pressure Drop in Horizontal Wells and Its Effect on Production Performance, SPE 19824, pp. 1426-1433, 1990.

(Continued)

*Primary Examiner* — Jennifer H Gay
*Assistant Examiner* — Yong-Suk Ro
(74) *Attorney, Agent, or Firm* — Mossman, Kumar & Tyler, PC

(57) ABSTRACT

An apparatus for controlling fluid flow into a wellbore tubular includes a flow control member that selectively aligns a port with an opening in communication with a flow bore of the well bore tubular. The flow control member may have an open position wherein the port is aligned with the opening and a closed position wherein the port is misaligned with the opening. The flow control member moves between the open position and closed position in response to a change in drag force applied by a flowing fluid. A biasing element urges the flow control member to the open or the closed position. The apparatus may include a housing receiving the flow control member. The flow control member and the housing may define a flow space that generates a Couette flow that causes the drag force. The flow space may include a hydrophilic and/or water swellable material.

20 Claims, 5 Drawing Sheets

U.S. PATENT DOCUMENTS

| | | | | |
|---|---|---|---|---|
| 2,412,841 | A | | 12/1946 | Spangler |
| 2,762,437 | A | | 1/1955 | Egan et al. |
| 2,810,352 | A | | 10/1957 | Tumilson |
| 2,942,668 | A | | 11/1957 | Maly et al. |
| 2,814,947 | A | | 12/1957 | Stegemeier et al. |
| 2,942,541 | A | | 7/1960 | Maly et al. |
| 3,326,291 | A | | 6/1967 | Zandmer |
| 3,385,367 | A | | 5/1968 | Kollsman |
| 3,419,089 | A | | 12/1968 | Venghiattis |
| 3,451,477 | A | | 6/1969 | Kelley |
| 3,675,714 | A | | 7/1972 | Thompson |
| 3,692,064 | A | | 9/1972 | Hohnerlein et al. |
| 3,739,845 | A | | 6/1973 | Berry et al. |
| 3,791,444 | A | | 2/1974 | Hickey |
| 3,876,471 | A | | 4/1975 | Jones |
| 3,918,523 | A | | 11/1975 | Stuber |
| 3,951,338 | A | | 4/1976 | Genna |
| 3,975,651 | A | | 8/1976 | Griffiths |
| 4,153,757 | A | | 5/1979 | Clark, III |
| 4,173,255 | A | | 11/1979 | Kramer |
| 4,180,132 | A | * | 12/1979 | Young ..... 166/120 |
| 4,186,100 | A | | 1/1980 | Mott |
| 4,187,909 | A | | 2/1980 | Erbstoesser |
| 4,248,302 | A | | 2/1981 | Churchman |
| 4,250,907 | A | | 2/1981 | Struckman et al. |
| 4,257,650 | A | | 3/1981 | Allen |
| 4,287,952 | A | | 9/1981 | Erbstoesser |
| 4,434,849 | A | | 3/1984 | Allen |
| 4,491,186 | A | | 1/1985 | Alder |
| 4,497,714 | A | | 2/1985 | Harris |
| 4,552,218 | A | | 11/1985 | Ross et al. |
| 4,572,295 | A | | 2/1986 | Walley |
| 4,614,303 | A | | 9/1986 | Moseley, Jr. et al. |
| 4,649,996 | A | | 3/1987 | Kojicic |
| 4,821,800 | A | | 4/1989 | Scott et al. |
| 4,856,590 | A | | 8/1989 | Caillier |
| 4,917,183 | A | | 4/1990 | Gaidry et al. |
| 4,944,349 | A | * | 7/1990 | Von Gonten, Jr. ..... 166/304 |
| 4,974,674 | A | | 12/1990 | Wells |
| 4,998,585 | A | | 3/1991 | Newcomer et al. |
| 5,004,049 | A | | 4/1991 | Arterbury |
| 5,016,710 | A | | 5/1991 | Renard et al. |
| 5,132,903 | A | | 7/1992 | Sinclair |
| 5,156,811 | A | | 10/1992 | White |
| 5,333,684 | A | | 8/1994 | Walter et al. |
| 5,337,821 | A | | 8/1994 | Peterson |
| 5,339,895 | A | | 8/1994 | Arterbury et al. |
| 5,377,750 | A | | 1/1995 | Arterbury et al. |
| 5,381,864 | A | | 1/1995 | Nguyen et al. |
| 5,431,346 | A | | 7/1995 | Sinaisky |
| 5,435,393 | A | | 7/1995 | Brekke et al. |
| 5,435,395 | A | | 7/1995 | Connell |
| 5,439,966 | A | | 8/1995 | Graham et al. |
| 5,551,513 | A | | 9/1996 | Surles et al. |
| 5,586,213 | A | | 12/1996 | Bridges |
| 5,597,042 | A | | 1/1997 | Tubel et al. |
| 5,609,204 | A | | 3/1997 | Rebardi et al. |
| 5,673,751 | A | | 10/1997 | Head et al. |
| 5,803,179 | A | | 9/1998 | Echols et al. |
| 5,829,522 | A | | 11/1998 | Ross et al. |
| 5,831,156 | A | | 11/1998 | Mullins |
| 5,839,508 | A | | 11/1998 | Tubel et al. |
| 5,873,410 | A | | 2/1999 | Iato et al. |
| 5,881,809 | A | | 3/1999 | Gillespie et al. |
| 5,896,928 | A | | 4/1999 | Coon |
| 5,982,801 | A | | 11/1999 | Deak |
| 6,068,015 | A | | 5/2000 | Pringle |
| 6,098,020 | A | | 8/2000 | Den Boer |
| 6,112,815 | A | | 9/2000 | Boe |
| 6,112,817 | A | | 9/2000 | Voll et al. |
| 6,119,780 | A | | 9/2000 | Christmas |
| 6,228,812 | B1 | | 5/2001 | Dawson et al. |
| 6,253,847 | B1 | | 7/2001 | Stephenson |
| 6,253,861 | B1 | | 7/2001 | Carmichael et al. |
| 6,273,194 | B1 | | 8/2001 | Hiron et al. |
| 6,305,470 | B1 | | 10/2001 | Woie |
| 6,338,363 | B1 | | 1/2002 | Chen et al. |
| 6,367,547 | B1 | | 4/2002 | Towers |
| 6,371,210 | B1 | | 4/2002 | Bode et al. |
| 6,372,678 | B1 | | 4/2002 | Youngman et al. |
| 6,419,021 | B1 | | 7/2002 | George et al. |
| 6,474,413 | B1 | | 11/2002 | Barbosa et al. |
| 6,505,682 | B2 | | 1/2003 | Brockman |
| 6,516,888 | B1 | | 2/2003 | Gunnarson et al. |
| 6,581,682 | B1 | | 6/2003 | Parent et al. |
| 6,622,794 | B2 | | 9/2003 | Zisk, Jr. |
| 6,632,527 | B1 | | 10/2003 | McDaniel et al. |
| 6,635,732 | B2 | | 10/2003 | Mentak |
| 6,667,029 | B2 | | 12/2003 | Zhong et al. |
| 6,679,324 | B2 | | 1/2004 | Den Boer et al. |
| 6,692,766 | B1 | | 2/2004 | Rubinstein et al. |
| 6,699,503 | B1 | | 3/2004 | Sako et al. |
| 6,699,611 | B2 | | 3/2004 | Kim et al. |
| 6,786,285 | B2 | | 9/2004 | Johnson et al. |
| 6,817,416 | B2 | | 11/2004 | Wilson et al. |
| 6,840,321 | B2 | | 1/2005 | Restarick et al. |
| 6,857,476 | B2 | | 2/2005 | Richards |
| 6,863,126 | B2 | | 3/2005 | McGlothen et al. |
| 6,938,698 | B2 | | 9/2005 | Coronado |
| 6,951,252 | B2 | | 10/2005 | Restarick et al. |
| 6,976,542 | B2 | | 12/2005 | Henriksen et al. |
| 7,011,076 | B1 | | 3/2006 | Weldon et al. |
| 7,084,094 | B2 | | 8/2006 | Gunn et al. |
| 7,159,656 | B2 | | 1/2007 | Eoff et al. |
| 7,185,706 | B2 | | 3/2007 | Freyer |
| 7,290,606 | B2 | | 11/2007 | Coronado et al. |
| 7,318,472 | B2 | | 1/2008 | Smith |
| 7,322,412 | B2 | | 1/2008 | Badalamenti et al. |
| 7,325,616 | B2 | | 2/2008 | Lopez De Cardenas |
| 7,395,858 | B2 | | 7/2008 | Barbosa et al. |
| 7,409,999 | B2 | | 8/2008 | Henriksen et al. |
| 7,469,743 | B2 | | 12/2008 | Richards |
| 7,673,678 | B2 | | 3/2010 | MacDougall et al. |
| 2002/0020527 | A1 | | 2/2002 | Kilaas et al. |
| 2002/0125009 | A1 | | 9/2002 | Wetzel et al. |
| 2003/0221834 | A1 | | 12/2003 | Hess et al. |
| 2004/0052689 | A1 | | 3/2004 | Yao |
| 2004/0144544 | A1 | | 7/2004 | Freyer |
| 2004/0194971 | A1 | | 10/2004 | Thomson |
| 2005/0016732 | A1 | | 1/2005 | Brannon et al. |
| 2005/0126776 | A1 | | 6/2005 | Russell |
| 2005/0171248 | A1 | | 8/2005 | Li et al. |
| 2005/0178705 | A1 | | 8/2005 | Broyles et al. |
| 2005/0189119 | A1 | | 9/2005 | Gynz-Rekowski |
| 2005/0199298 | A1 | | 9/2005 | Farrington |
| 2005/0207279 | A1 | | 9/2005 | Chemali et al. |
| 2005/0241835 | A1 | | 11/2005 | Burris et al. |
| 2006/0042798 | A1 | | 3/2006 | Badalamenti et al. |
| 2006/0048936 | A1 | | 3/2006 | Fripp et al. |
| 2006/0048942 | A1 | | 3/2006 | Moen et al. |
| 2006/0076150 | A1 | | 4/2006 | Coronado et al. |
| 2006/0086498 | A1 | | 4/2006 | Wetzel et al. |
| 2006/0108114 | A1 | | 5/2006 | Johnson |
| 2006/0175065 | A1 | | 8/2006 | Ross |
| 2006/0185849 | A1 | | 8/2006 | Edwards et al. |
| 2006/0272814 | A1 | | 12/2006 | Broome et al. |
| 2006/0273876 | A1 | | 12/2006 | Pachla et al. |
| 2007/0012444 | A1 | | 1/2007 | Horgan et al. |
| 2007/0039741 | A1 | | 2/2007 | Hailey, Jr. |
| 2007/0044962 | A1 | | 3/2007 | Tibbles |
| 2007/0131434 | A1 | | 6/2007 | MacDougall et al. |
| 2007/0246210 | A1 | | 10/2007 | Richards |
| 2007/0246213 | A1 | | 10/2007 | Hailey, Jr. |
| 2007/0246225 | A1 | * | 10/2007 | Hailey et al. ..... 166/386 |
| 2007/0246407 | A1 | | 10/2007 | Richards et al. |
| 2007/0272408 | A1 | | 11/2007 | Zazovsky et al. |
| 2008/0035349 | A1 | | 2/2008 | Richard |
| 2008/0035350 | A1 | | 2/2008 | Henriksen |
| 2008/0053662 | A1 | | 3/2008 | Williamson et al. |
| 2008/0135249 | A1 | | 6/2008 | Fripp et al. |
| 2008/0149323 | A1 | | 6/2008 | O'Malley et al. |
| 2008/0149351 | A1 | | 6/2008 | Marya et al. |
| 2008/0236839 | A1 | | 10/2008 | Oddie |
| 2008/0236843 | A1 | | 10/2008 | Scott et al. |
| 2008/0283238 | A1 | | 11/2008 | Richards et al. |
| 2008/0296023 | A1 | | 12/2008 | Willauer |
| 2008/0314590 | A1 | | 12/2008 | Patel |

| | | | | |
|---|---|---|---|---|
| 2009/0056816 | A1 * | 3/2009 | Arov et al. | 137/467 |
| 2009/0133869 | A1 | 5/2009 | Clem | |
| 2009/0133874 | A1 | 5/2009 | Dale et al. | |
| 2009/0139727 | A1 | 6/2009 | Tanju et al. | |
| 2009/0205834 | A1 | 8/2009 | Garcia et al. | |

FOREIGN PATENT DOCUMENTS

| | | | |
|---|---|---|---|
| GB | 1492345 | | 11/1977 |
| GB | 2341405 | | 12/2007 |
| JP | 59089383 | B2 | 5/1984 |
| JP | 59089383 | | 6/1984 |
| SU | 1335677 | A | 9/1987 |
| WO | 9403743 | A1 | 2/1994 |
| WO | WO 94/03743 | | 2/1994 |
| WO | WO 00/79097 | | 5/2000 |
| WO | WO 01/65063 | | 2/2001 |
| WO | WO 01/77485 | | 3/2001 |
| WO | WO02/075110 | | 9/2002 |
| WO | WO2004/018833 | A1 | 3/2004 |
| WO | WO2006/015277 | | 7/2005 |

OTHER PUBLICATIONS

Restarick, Henry, Horizontal Completion Options in REservoirs With Sand Problems, SPE 29831, pp. 545-560, 1995.

Xue, W., Hamley, I. W. and Huglin, "Rapid Swelling and Deswelling of Thermoreversible Hydrophobically Modified Poly(N-Isopropylacrylamide) Hydrogels Prepared by Freezing Polymerisation", M. B., 43(1), pp. 5181-5186, 2002.

Xue, W., Champ, S. and Huglin, "Thermoreversible Swelling Behavior of Hydrogels Based on N-Isopropylacrylamide with a Zwitterionic Comonomer", M. B., European Polymer Journal, pp. 37(5) 869-875, 2001.

Dinarvand, R., D'Emanuele, "The use of thermoresponsive hydrogels for on-off release of molecules", J. Control. Rel. 36, pp. 221-227, A 1995.

Tanaka, T., Nishio, I., Sun, S.T., Ueno-Nisho, S., "Collapse of gels in an electric field", Science, pp. 218:467-469, 1982.

Ishihara,K., Hamada, N., Sato, S., Shinohara, I., "Photoinduced serlling control of amphiphdilic azoaromatic polymer membrane". J. Polym. Sci., Polym. Chem. Ed. 22: pp. 121-128, 1984.

Ricka, J. Tanaka, T., "Swelling of Ionic gels: Quantitative performance of the Donnan Thory, Macromolecules", 17, pp. 2916-2921, 1984.

Stephen P. Mathis, Baker Oil Tools, "Sand Management: A Review of Approaches and Concerns; SPE 82240"; Presented at the SPE European Formation Damage Conference, Hague, The Netherlands 13-14; Copyright 2003, Society of Petroleum Engineers Inc, May 2003.

E. Paul Bercegeay, University of Southwestern Louisiana; Charles A. Richard, Baker Oil Tools, Inc. Member AIME; "A One-Trip Gravel Packing System, SPE 4771"; Prepared for the Society of Petroleum Engineers of AIME Symposium on Formation Damage Control, New Orleans, La., Feb. 7-8, 1974; Copyright 1974, American Institute of Mining, Metallurgical and Petroleum Engineers, Inc.

Optimization of Commingled Production Using Infinitely Variable Inflow Control Valves; M.M, J. J. Naus, Delft University of Technology (DUT), Shell International Exploration and production (SIEP); J.D. Jansen, DUT and SIEP; SPE Annual Technical Conference and Exhibition, Sep. 26-29 Houston, Texas, 2004, Society of Patent Engineers.

An Oil Selective Inflow Control System; Rune Freyer, Easy Well Solutions; Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Determination of Perforation Schemes to Control Production and Injection Profiles Along Horizontal; Asheim, Harald, Norweigian Institute of Technology; Oudeman, Pier, Koninklijke/Shell Exploratie en Producktie Laboratorium; SPE Drilling & Completion, vol. 12, No. 1, March; pp. 13-18; 1997 Society of Petroleum Engineers.

* cited by examiner

WATER SENSITIVE ADAPTIVE INFLOW CONTROL USING COUETTE FLOW TO ACTUATE A VALVE

CROSS-REFERENCE TO RELATED APPLICATIONS

This application takes priority from U.S. Provisional Application Ser. No. 60/990,536, filed Nov. 27, 2007.

BACKGROUND OF THE DISCLOSURE

1. Field of the Disclosure

The disclosure relates generally to systems and methods for selective control of fluid flow between a production string and a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. These production zones are sometimes separated from each other by installing a packer between the production zones. Fluid from each production zone entering the wellbore is drawn into a tubing that runs to the surface. It is desirable to have substantially even drainage along the production zone. Uneven drainage may result in undesirable conditions such as an invasive gas cone or water cone. In the instance of an oil-producing well, for example, a gas cone may cause an inflow of gas into the wellbore that could significantly reduce oil production. In like fashion, a water cone may cause an inflow of water into the oil production flow that reduces the amount and quality of the produced oil. Accordingly, it is desired to provide even drainage across a production zone and/or the ability to selectively close off or reduce inflow within production zones experiencing an undesirable influx of water and/or gas.

The present disclosure addresses these and other needs of the prior art.

SUMMARY OF THE DISCLOSURE

In aspects, the present disclosure provides an apparatus for controlling a flow of a fluid into a wellbore tubular in a wellbore. In one embodiment, the apparatus includes a first member configured to selectively align a port with an opening in communication with a flow bore of the wellbore tubular. The first member has an open position wherein the port is aligned with the opening and a closed position wherein the port is misaligned with the opening. A biasing element may urge the first member to the closed position. The apparatus may also include an outer member that receives the first member. The outer member and the first member may define a flow space having at least one dimension selected to cause a Couette flow in the flow space. The dimension is selected to cause a fluid flowing in the flow space to apply a drag force on the first member that moves the first member to the open position. The dimension may be a size of a gap separating the outer member and the first member. The first member may translate or rotate between the open and closed position. In embodiments, a surface defining the flow space includes a material that increases surface friction when exposed to oil and/or a material that swells when exposed to oil. In embodiments, the biasing element may be configured to allow the first member to move to the open position when a fluid having mostly oil flows in the flow space.

In aspects, the present disclosure provides a method for controlling a flow of a fluid into a wellbore tubular in a wellbore. The method may include conveying the fluid from the formation into a flow bore of the wellbore through a flow space in communication with a port that can be selectively aligned with an opening; and applying a drag force on a member associated with the port that aligns the port with the opening when mostly oil flows through the flow space. In embodiments, the method may include reducing the drag force when mostly water flows through the flow space. The method may further include biasing the member to an open position wherein the port is substantially aligned with the opening.

In aspects, the present disclosure provides an apparatus for controlling a flow of a fluid into a wellbore tubular in a wellbore. The apparatus may include a flow control member that is configured to selectively align a port with an opening in communication with a flow bore of the wellbore tubular. The flow control member may have an open position wherein the port is aligned with the opening and a closed position wherein the port is misaligned with the opening. The flow control member may be configured to move between the open position and the closed position in response to a change in drag force applied by a flowing fluid. In one arrangement, the apparatus may include a housing receiving the flow control member. An outer surface of the flow control member and an inner surface of the housing may define a flow space. In one embodiment, the flow space may be configured to cause a Couette flow in the flow space that applies a drag force to the flow control member that moves the flow control member to the open position. In another embodiment, the flow space may be configured to cause a Couette flow in the flow space that applies a drag force to the flow control member that moves the flow control member to the closed position. In embodiments, at least one surface defining the flow space may include a hydrophilic material, and/or a water swellable material.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
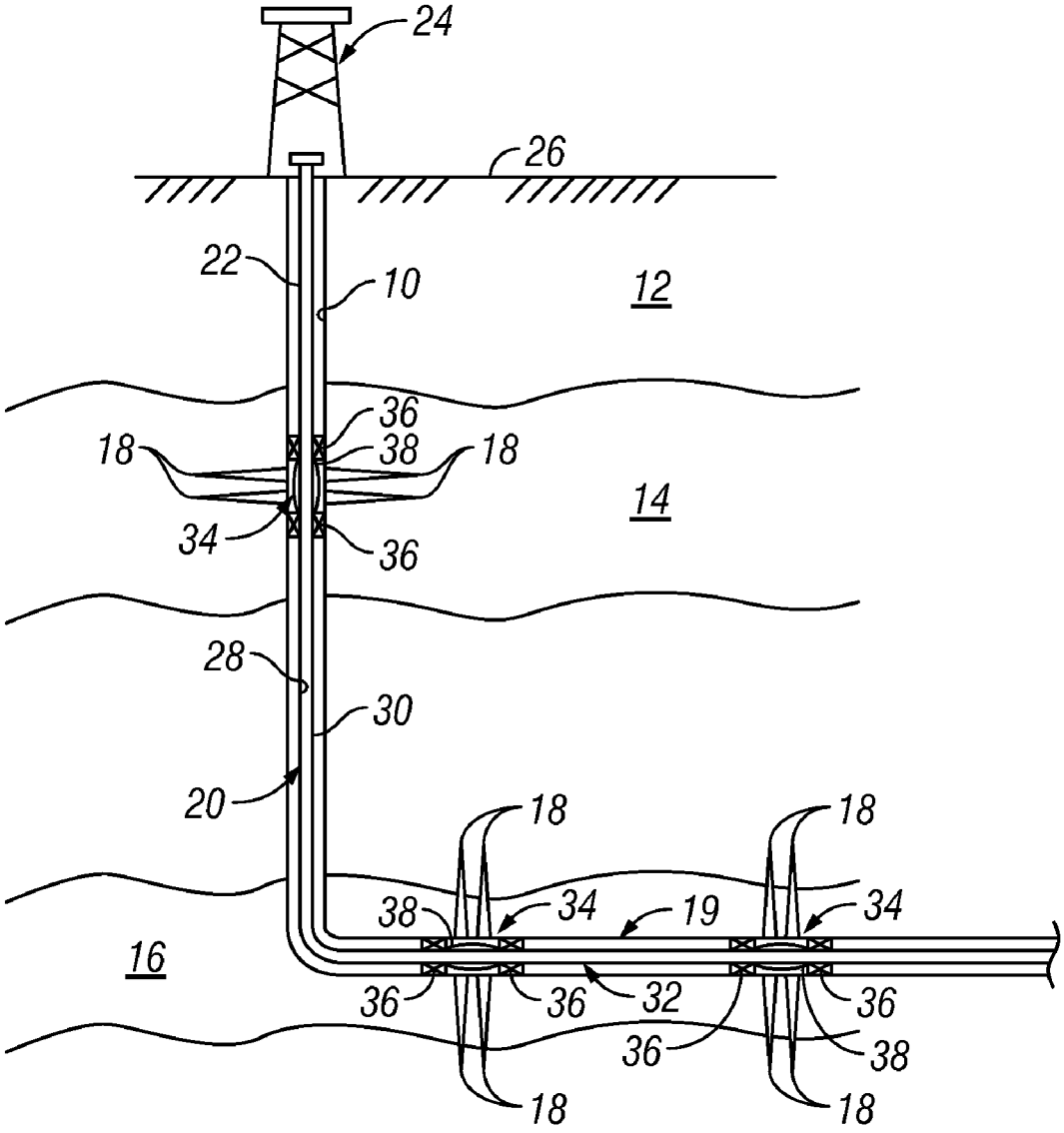
FIG. 1 is a schematic elevation view of an exemplary multi-zonal wellbore and production assembly which incorporates an inflow control system in accordance with one embodiment of the present disclosure.

The present disclosure relates to devices and methods for controlling production of a hydrocarbon producing well. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. Production nipples 34 are positioned at selected points along the production assembly 20. Optionally, each production nipple 34 is isolated within the wellbore 10 by a pair of packer devices 36. Although only two production nipples 34 are shown in FIG. 1, there may, in fact, be a large number of such nipples arranged in serial fashion along the horizontal portion 32.

Each production nipple 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. In accordance with embodiments of the present disclosure, the production control device 38 may have a number of alternative constructions that ensure selective operation and controlled fluid flow therethrough.

Figure 2:
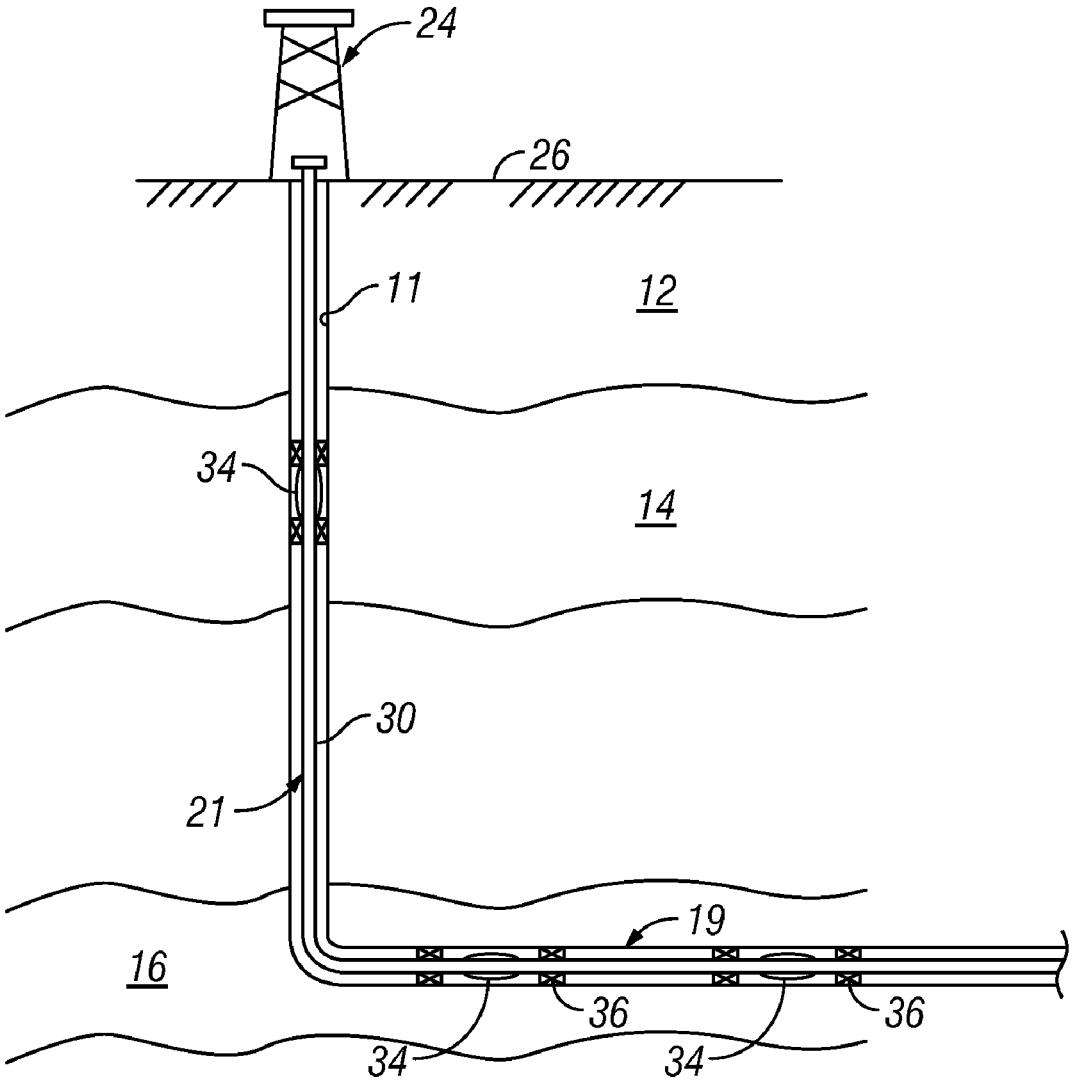
FIG. 2 is a schematic elevation view of an exemplary open hole production assembly which incorporates an inflow control system in accordance with one embodiment of the present disclosure.

FIG. 2 illustrates an exemplary open hole wellbore arrangement 11 wherein the production devices of the present disclosure may be used. Construction and operation of the open hole wellbore 11 is similar in most respects to the wellbore 10 described previously. However, the wellbore arrangement 11 has an uncased borehole that is directly open to the formations 14, 16. Production fluids, therefore, flow directly from the formations 14, 16, and into the annulus 30 that is defined between the production assembly 21 and the wall of the wellbore 11. There are no perforations, and the packers 36 may be used to separate the production nipples. However, there may be some situations where the packers 36 are omitted. The nature of the production control device is such that the fluid flow is directed from the formation 16 directly to the nearest production nipple 34.

Figure 3:
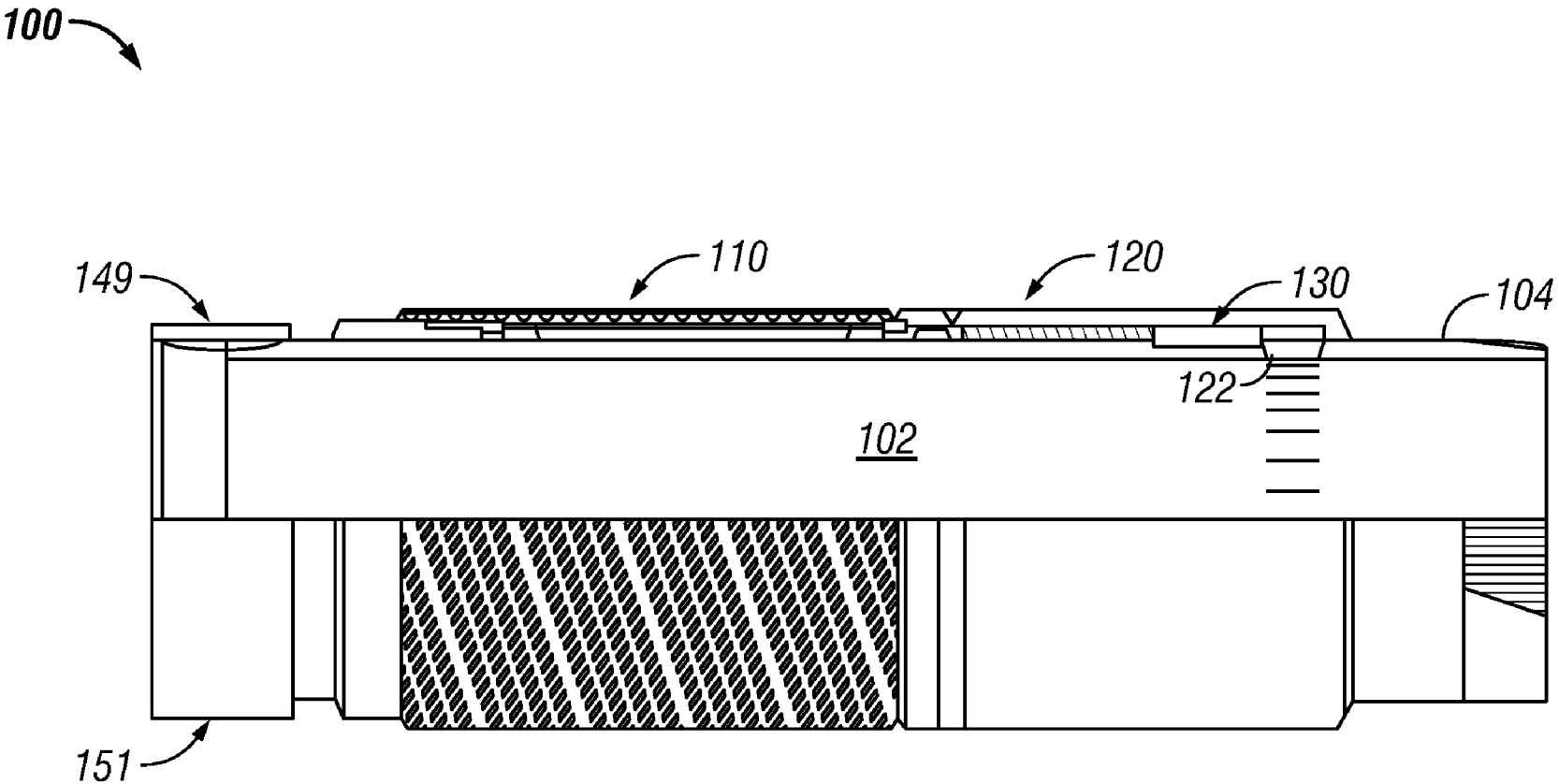
FIG. 3 is a schematic cross-sectional view of an exemplary production control device made in accordance with one embodiment of the present disclosure.

Referring now to FIG. 3, there is shown one embodiment of a production control device 100 for controlling the flow of fluids from a reservoir into a flow bore 102 of a tubular 104 along a production string (e.g., tubing string 22 of FIG. 1). This flow control can be a function of one or more characteristics or parameters of the formation fluid, including water content, fluid velocity, gas content, etc. Furthermore, the control devices 100 can be distributed along a section of a production well to provide fluid control at multiple locations. This can be advantageous, for example, to equalize production flow of oil in situations wherein a greater flow rate is expected at a "heel" of a horizontal well than at the "toe" of the horizontal well. By appropriately configuring the production control devices 100, such as by pressure equalization or by restricting inflow of gas or water, a well owner can increase the likelihood that an oil bearing reservoir will drain efficiently. Exemplary production control devices are discussed herein below.

In one embodiment, the production control device 100 includes a particulate control device 110 for reducing the amount and size of particulates entrained in the fluids and an in-flow control device 120 that controls overall drainage rate from the formation. The particulate control device 110 can include known devices such as sand screens and associated gravel packs. In embodiments, the in-flow control device 120 utilizes a flow control device 130 that utilizes Couette flow to control in-flow rate and/or the type of fluids entering the flow bore 102 via one or more flow bore orifices 122. Illustrative embodiments of flow control devices and members that are actuated by a change in drag forces generated by Couette flow are described below.

An exemplary flow control device 200 is adapted to control the in-flow area based upon the composition (e.g., oil, water, water concentration, etc) of the in-flowing fluid. Moreover, embodiments of the flow control device 200 are passive. By "passive," it is meant that the in-flow control device 200 controls in-flow area without human intervention, intelligent control, or an external power source. Illustrative human intervention includes the use of a work string to manipulate a sliding sleeve or actuate a valve. Illustrative intelligent control includes a control signal transmitted from a downhole or surface source that operates a device that opens or closes a flow path. Illustrative power sources include downhole batteries and conduits conveying pressurized hydraulic fluid or electrical power lines. Embodiments of the present disclosure are, therefore, self-contained, self-regulating and can function as intended without external inputs, other than interaction with the production fluid.

Figure 4A:
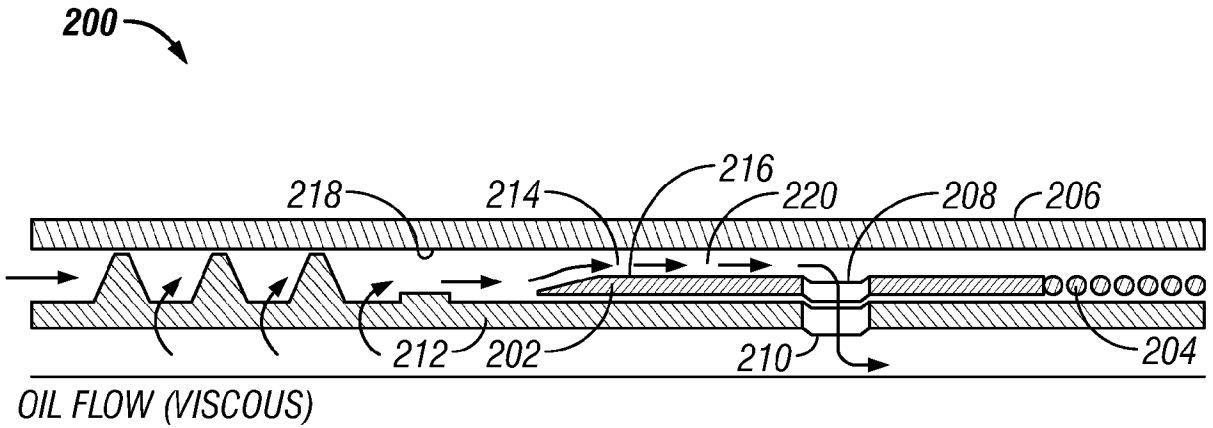
FIGS. 4A and B are sectional schematic views of a flow control device made in accordance with one embodiment of the present disclosure.
Figure 4B:
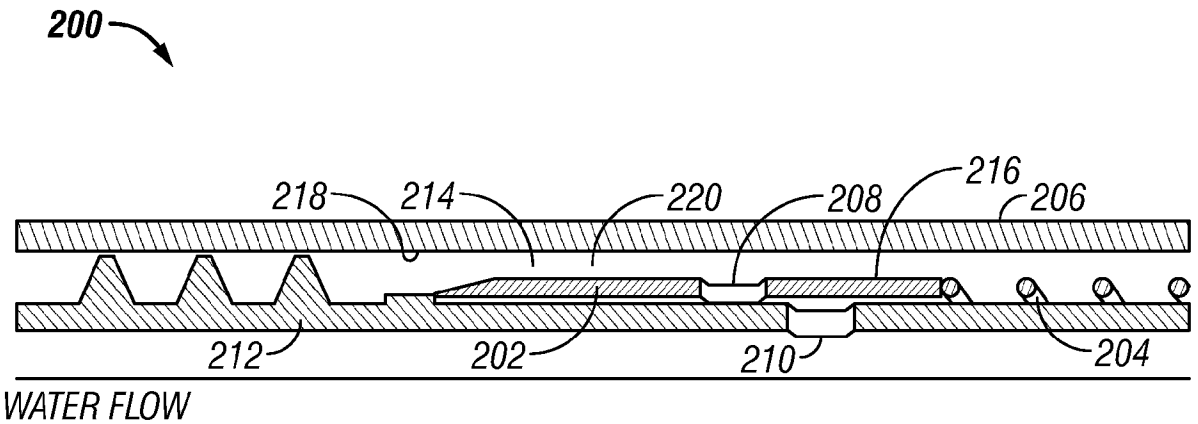

Referring now to FIGS. 4A and 4B, there is shown one embodiment of a flow control device 200 that controls fluid in-flow based upon the composition of the in-flowing fluid. The flow control device 200 includes a translating sleeve 202 and a biasing element 204 that are positioned within a housing 206, which may be a section of the in-flow control device 120 (FIG. 3). The translating sleeve 202 includes a port 208 that may be aligned with an opening 210 formed in an inner housing or mandrel 212. As used herein, when aligned, fluid communication is established through the port 208 and the opening 210. When misaligned, fluid communication at least partially blocked or restricted through the port 208 and the opening 210. In embodiments, the opening 210 may be the opening or openings 122 shown in FIG. 3. A flow space 214 formed between an outer surface 216 of the sleeve 202, which is free to move, and an inner surface 218 of the housing 206, which is stationary, has dimensions (e.g., width, circumference, etc.) selected to cause a Couette flow that applies a drag force on the sleeve 202. In aspects, the Couette flow occurs between two surfaces 216 and 218 that are separated by a gap 220. The magnitude of the drag force varies with the composition of the fluid flowing in the flow space 214 and the dimensions of the flow space 214, such as the size of the gap 220. Thus, the flow of viscous fluids such as oil generates a greater drag force on the sleeve 202 than the flow of non-viscous fluids such as water. The sleeve 212 may be a tubular member, a flat plate or any other body or object that presents a surface and flow space suitable for enabling the use of Couette flow.

In one arrangement, the sleeve 202 slides between an open position and a closed position in response to a change in concentration of water, or water cut, in the fluid flowing in the flow space 214. In an open position shown in FIG. 4A, the port 208 and the opening 210 are aligned to allow fluid flow into a flow bore of a production tubular. In a closed position shown in FIG. 4B, the port 208 and the opening 210 are misaligned to restrict or block fluid flow into a flow bore of a production tubular. The biasing element 204 applies an axial biasing force that urges the sleeve 202 to the closed position. However, the drag force on the sleeve 202 caused by the flow of a viscous fluid such as oil in the flow space 214 counteracts this axial biasing force and maintains the sleeve 202 in the open position. Thus, in one aspect, the biasing element 204 is configured to apply an axial biasing force that may be counteracted by the drag force associated with a flow of a viscous fluid but the axial biasing force may overcome the drag force associated with a flow of a non-viscous fluid.

During an exemplary mode of operation, a fluid consisting mostly of oil flows along the flow space 214. The drag force applied by this viscous fluid to the outer surface 216 of the sleeve 202 overcomes the biasing force of the biasing element 204 and pushes the sleeve 202 to the open position wherein the port 208 and the opening 210 are aligned to allow fluid flow into a flow bore of a production tubular, e.g., flow bore 102 of FIG. 3. If the water cut increases in the fluid flowing along the flow space 214, there may be a corresponding drop in the drag force applied to the outer surface 216 of the sleeve 202. If the water cut is sufficiently high, then the reduction in the applied drag force allows the biasing force of the biasing element 204 to push the sleeve 202 to the closed position, wherein the port 208 and the opening 210 are misaligned to restrict or block fluid flow into a flow bore of a production tubular, e.g., flow bore 102 of FIG. 3. It should, therefore, be appreciated that a change in drag force that accompanies a change in the composition of a flowing fluid actuates the flow control device 200 and initiates movement of the sleeve 202.

It should be appreciated that the FIG. 4 embodiment is susceptible to numerous variations. For example, the closed position need not completely block the flow of fluid into the production flow bore. That is, the open position may provide a maximum flow of fluid flow and the closed position may provide a reduced amount of flow. Such an arrangement may be advantageous in situations wherein where the water cut could drop over time. Thus, by allowing flow in the closed position, the sleeve 202 may be returned to an open position as the amount of oil in the fluid flowing in the flow space 214 increases to increase the applied drag force on the sleeve 202. Either the flow of oil may reset the sleeve 202 to the open position or a suitable setting tool may shift the sleeve 202 to the open position. The setting tool (not shown) may be conveyed via a wire line or tubing string. Illustrative setting tools may utilize a mechanical engagement, a magnetic connection, a pressurized fluid, or other suitable method to move the sleeve 202. Thus, in aspects, the flow control device 200 may throttle or vary in-flow rates based on the composition of the in-flowing fluid. Additionally, while a spring-like element is shown as the biasing element 204, other devices suited to provide a biasing force, such as a compressed fluid, may also be utilized.

Additionally, in embodiments, some or all of the surfaces defining the flow space 214, such as outer surface 216 and inner surface 218, may be constructed to have a specified frictional resistance to flow that can either enhance or inhibit Couette flow. In some embodiments, the friction may be increased using textures, roughened surfaces, or other such surface features. Alternatively, friction may be reduced by using polished or smoothed surfaces. In embodiments, the surfaces may be coated with a material that increases or decreases surface friction. Moreover, the coating may be configured to vary the friction based on the nature of the flowing material (e.g., water or oil). For example, the surface may be coated with a hydrophilic material that absorbs water to increase frictional resistance to water flow or a hydrophobic material that repels water to decrease frictional resistance to water flow. Additionally, the surface may be coated with an oleophilic or oil wettable material that increases frictional resistance to oil flow. In the instance of an oleophilic material, the increased resistance to oil flow can increase the drag force available to counteract the biasing element 204.

Moreover, in embodiments, some or all of the surfaces such as outer surface 216 and inner surface 218 defining the flow space 214 may be constructed to cause a change in shape or dimension of the flow space 214 to either enhance or inhibit Couette flow. For example, in embodiments, the surfaces may be coated with a material that swells or shrinks to increase or decrease a dimension of the flow space 214. For instance, a surface may be coated with a material that swells when exposed to oil. The reduction in the size of the gap 220 of the flow space 214 may increase a drag force associated with Couette flow when oil flows through the flow space 214. The increased drag force may be used to more effectively counteract the biasing force applied by the biasing element 204. Conversely, when water flows through the flow space 214, the increase in width of the flow space 214 may decrease the drag force associated with Couette flow to more easily permit the biasing element 204 to urge the sleeve 202 to the closed position.

Figure 5:
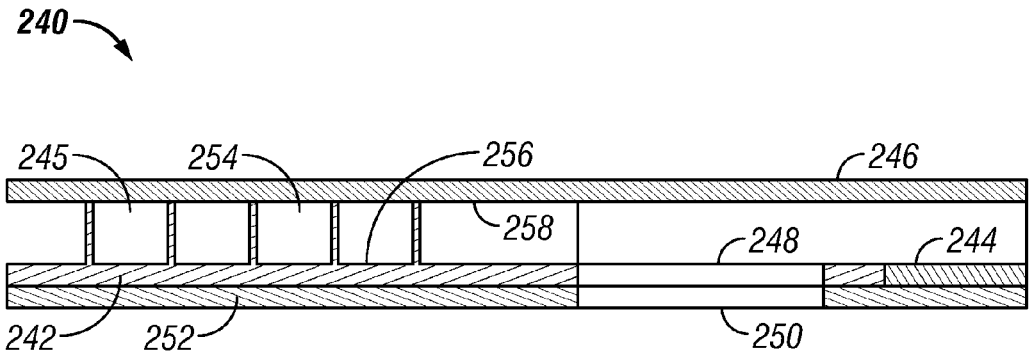
FIG. 5 is a sectional schematic view of a flow control device made in accordance with one embodiment of the present disclosure that uses rotational motion.

Referring now to FIG. 5, there is shown another embodiment of a flow control device 240 that controls fluid in-flow based upon the composition of the in-flowing fluid. The flow control device 240 includes a rotating flow control member such as a sleeve 242 and a biasing element 244 that are positioned within a housing 246, which may be a section of the in-flow control device 120 (FIG. 3). The rotating sleeve 242 includes one or more slots 248 may be aligned with one or more openings 250 formed in an inner housing or mandrel 252. Where multiple slots 248 and openings 250 are utilized, the slots 248 and openings 250 may be partially or completely circumferentially arrayed around the mandrel 252. A flow space 254 formed between an outer surface 256 of the sleeve 242 and an inner surface 258 of the housing 246 has a profile (e.g., a gap size) selected to cause a Couette flow that applies a drag force on the sleeve 242. In one embodiment, the outer surface 256 of the sleeve 242 includes a helical flow path formed by one or more channels 245. In one embodiment, the channels 245 direct flow helically around the sleeve 242. Thus, the drag force associated with the Couette flow is oriented to provide a torsion force that tends to rotate the sleeve 242. The channels 245 may be partially or fully circumscribe the sleeve 242.

In one arrangement, the sleeve 242 rotates between an open position and a closed position in response to a change in concentration of water, or water cut, in the fluid flowing in the flow space 214. In a fully open position, the slots 248 and the openings 250 are aligned to allow fluid flow into a flow bore of a production tubular. In a closed position, the ports 248 and the opening 250 are misaligned to restrict or block fluid flow into a flow bore of a production tubular. The biasing element 244 applies a torsional biasing force that tends to rotate the sleeve 242 to the fully closed position. In a manner previously described, the drag force on the sleeve 242 caused by the flow of a viscous fluid such as oil in the flow space 244 counteracts this torsional biasing force and rotates the sleeve 242 to the open position.

During an exemplary mode of operation, a fluid consisting mostly of oil flows along the flow space 254. The drag force applied by this viscous fluid to the outer surface 256 of the sleeve 242 overcomes the biasing force of the biasing element 244 and rotates the sleeve 242 to the open position wherein the slots 248 and the openings 250 are aligned to allow fluid flow into a flow bore of a production tubular. If the water cut increases in the fluid flowing along the flow space 254, there may be a corresponding drop in the drag force applied to the outer surface 256 of the sleeve 242. If the water cut is sufficiently high, then the biasing force of the biasing element 244 rotates the sleeve 242 to the closed position, wherein the slots 248 and the opening 250 are misaligned to restrict or block fluid flow into a flow bore of a production tubular.

Figure 6:
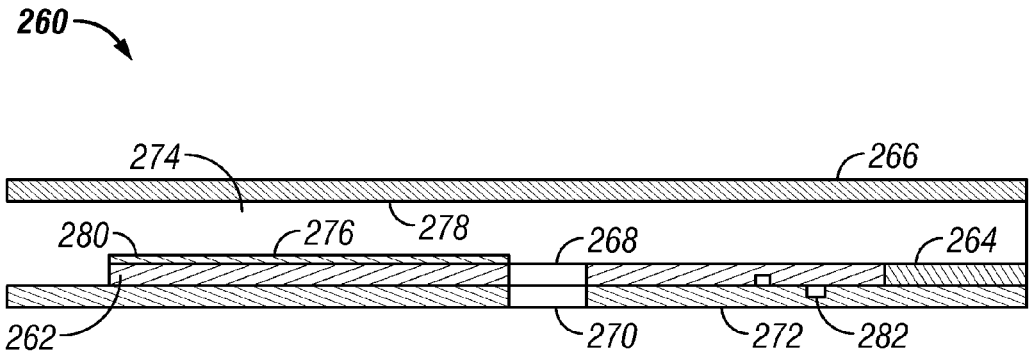
FIG. 6 is a sectional schematic view of a flow control device made in accordance with one embodiment of the present disclosure that is actuated by a water flow.

Referring now to FIG. 6, there is shown yet another embodiment of a flow control device 260 that controls fluid in-flow based upon the composition of the in-flowing fluid. The flow control device 260 includes a translating flow control member such as a sleeve 262 and a biasing element 264 that are positioned within a housing 266, which may be a section of the in-flow control device 120 (FIG. 3). The translating sleeve 262 includes one or more slots 268 that may be aligned with one or more openings 270 formed in an inner housing or mandrel 272. The biasing element 264 applies an axial biasing force that urges the sleeve 262 to an open position wherein the slots 268 and the openings 270 are aligned. A flow space 274 is formed between an outer surface 276 of the sleeve 262 and an inner surface 278 of the housing 266. The outer surface 276 of the sleeve 262 includes a layer or coating of hydrophilic material 280. The flow space 274 has a profile (e.g., a gap size) that causes a Couette flow when water flows through the flow space 274. That is, the hydrophilic material 280 increases resistance to the flow of water such that a drag force is applied to the sleeve 262. This drag force, when of sufficient magnitude, urges the sleeve 262 to a closed position wherein the slots 268 and the openings 270 are misaligned. A locking device 282 may be used to lock the sleeve 262 in the closed position. It should be appreciated that, in certain embodiments, the biasing member 262 may be omitted if the sleeve 262 has sufficient resistance to the flow of mostly oil in the flow space 274. Also, in variants, the sleeve 262 may include a layer of water swellable material that swells when exposed to water, which then causes a Couette flow by reducing the dimension of the flow space 274. In yet another variant, the water swellable material may simply choke flow across the flow space 274 such that a fluid applied to the sleeve 262 moves the sleeve 262 to the closed position. That is, a Couette flow may not be required to actuate the sleeve 262.

It should be understood that FIGS. 1 and 2 are intended to be merely illustrative of the production systems in which the teachings of the present disclosure may be applied. For example, in certain production systems, the wellbores 10, 11 may utilize only a casing or liner to convey production fluids to the surface. The teachings of the present disclosure may be applied to control flow through these and other wellbore tubulars. Furthermore, the flow control devices of the present disclosure may also be used to control flow in other situations. For example, the present teachings may be applied to injection well scenarios where fluid is conveyed from the wellbore tubular into the formation. Thus, embodiments of the present disclosure may control fluid flow both into and out of a wellbore tubular.

For the sake of clarity and brevity, descriptions of most threaded connections between tubular elements, elastomeric seals, such as o-rings, and other well-understood techniques are omitted in the above description. Further, terms such as "slot," "passages," and "channels" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. An apparatus for controlling a flow of a fluid into a wellbore tubular in a wellbore, comprising:

a port aligned with an opening in communication with a flow bore of the wellbore tubular;

a first member operatively coupled to the port;

a biasing element applying a biasing force to the first member; and an outer member positioned along the wellbore tubular and being separated from a wellbore wall by an annulus receiving the first member, wherein the outer member and the first member define a flow space having at least one dimension selected to cause a Couette fluid flow that applies a drag force to the first member that opposes the biasing force.

2. The apparatus according to claim 1 wherein the drag force overcomes the biasing force of the biasing element when a fluid having mostly oil flows in the flow space.

3. The apparatus according to claim 1 wherein the drag force on the first member decreases as a water cut in the flowing fluid increases.

4. The apparatus according to claim 1 wherein a surface defining the flow space changes a resistance to flow when exposed to oil.

5. The apparatus according to claim 1 wherein a surface defining the flow space changes a resistance to flow when exposed to water.

6. The apparatus of claim 1, wherein the first member is configured to translate; and further comprising a particulate control device positioned adjacent to the first member.

7. The apparatus of claim 1 wherein the first member is configured to rotate.

8. The apparatus according to claim 1 wherein the port and the opening are configured to allow fluid flow when the port and the opening are aligned and misaligned.

9. A method for controlling a flow of a fluid into a wellbore tubular in a wellbore, comprising:

conveying the fluid from the formation into a flow bore of the wellbore tubular through a flow space in communication with a port that can be selectively aligned with an opening in the wellbore tubular;

applying a biasing force on a member associated with the port as fluid flows through the opening; and applying a drag force on the member to align the port and opening and to keep the port aligned with the opening when mostly oil flows through the flow space.

10. The method according to claim 9, further comprising:

applying the biasing force when mostly oil flows through the flow space and when mostly water flows through the flow space; and reducing the drag force when mostly water flows through the flow space.

11. The method according to claim 9, further comprising configuring the flow space to generate a Couette flow that causes the drag force.

12. The method according to claim 11, further comprising positioning the member in a housing, wherein an outer surface of the member and an inner surface of the housing defines the flow space.

13. The method according to claim 12, wherein at least one surface defining the flow space changes a resistance to flow when exposed to oil.

14. The method according to claim 12, wherein at least one surface defining the flow space changes a resistance to flow when exposed to water.

15. The method according to claim 9 further comprising flowing fluid through the port and the opening in the open position and a closed position wherein the port and the opening are misaligned.

16. An apparatus for controlling a flow of a fluid into a wellbore tubular in a wellbore, comprising:

an outer member positioned along the wellbore tubular and being separated from a wellbore wall by an annulus; and a flow control member coupled to the outer member, the flow control member having an open position and a closed position, wherein moving from the open position to the closed position reduces fluid flow into an opening in communication with a bore of the wellbore tubular, wherein a space between the flow control member and the outer member has at least one dimension selected to cause a Couette fluid flow that generates a drag force to move the flow control member to the open position and to keep the flow control member in the open position.

17. The apparatus according to claim 16 further comprising a housing receiving the flow control member, wherein an outer surface of the flow control member and an inner surface of the housing define a flow space.

18. The apparatus according to claim 17 wherein the flow space is configured to cause a Couette flow in the flow space that applies a drag force that maintains the flow control member in the open position.

19. The apparatus according to claim 18 further comprising a biasing member that moves the flow control member to the closed position when mostly water flows through the flow space.

20. The apparatus according to claim 17 wherein at least one surface defining the flow space includes one of: (i) a hydrophilic material, and (ii) a water swellable material.

* * * * *